US005189972A

United States Patent [19]

Mitsui et al.

[11] Patent Number: 5,189,972

[45] Date of Patent: Mar. 2, 1993

[54] HORIZONTAL AXIS FULL ROTARY HOOK WITH A BOBBIN CASE HOLDER HAVING A NEEDLE GUIDING MEANS

[75] Inventors: Hiroyuki Mitsui, Kasugai; Satoshi Morii, Nagoya; Toshiaki Iwasaki, Nagoya; Minoru Yamaguchi, Nagoya, all of Japan

[73] Assignee: Brother Kogyo Kabushiki Kaisha, Nagoya, Japan

[21] Appl. No.: 858,646

[22] Filed: Mar. 27, 1992

[30] Foreign Application Priority Data

Mar. 31, 1991 [JP] Japan ..... 3-92755

[51] Int. Cl.[5] ..... D05B 55/06; D05B 57/14

[52] U.S. Cl. ..... 112/227; 112/231

[58] Field of Search ..... 112/228, 229, 230, 231, 112/181, 182, 183, 184, 227

[56] References Cited

U.S. PATENT DOCUMENTS

| | | | |
|---|---|---|---|
| 2,394,511 | 2/1946 | Clayton . | |
| 2,680,417 | 6/1954 | Graesser . | |
| 3,023,721 | 3/1962 | Johnson . | |
| 3,067,703 | 12/1962 | Gustin | 112/230 |
| 3,313,259 | 4/1967 | Daniel et al. | 112/227 X |
| 3,381,643 | 5/1968 | Meloy, Jr. | 112/231 |
| 4,285,291 | 8/1981 | Ackermann et al. | 112/227 X |
| 4,660,485 | 4/1987 | Morgan . | |
| 4,858,543 | 8/1989 | Badillo | 112/231 |
| 4,991,526 | 2/1991 | Jean Blanc | 112/227 |

FOREIGN PATENT DOCUMENTS

| | | |
|---|---|---|
| 3010643 | 9/1980 | Fed. Rep. of Germany . |
| 14-2160 | 1/1939 | Japan . |
| 41-18759 | 9/1941 | Japan . |
| 41-19370 | 9/1941 | Japan . |
| 38-15734 | 8/1963 | Japan . |
| 45-31887 | 12/1970 | Japan . |
| 49-76842 | 7/1974 | Japan . |

*Primary Examiner*—Peter Nerbun
*Assistant Examiner*—Paul C. Lewis
*Attorney, Agent, or Firm*—Oliff & Berridge

[57] ABSTRACT

A horizontal axis full rotary hook for a sewing machine, including a generally cylindrical hook base having a point of hook, an inner circumferential surface, and a guide groove formed in the inner circumferential surface; and a generally cylindrical bobbin-case holder having an inner circumferential surface, an outer circumferential surface, and a part-circumferential rail provided on the outer circumferential surface, the bobbin-case holder being supported by the hook base such that the bobbin-case holder is freely rotatable relative to the rotary hook while the rail is guided in the guide groove, the bobbin-case holder having a needle aperture which allows a sewing needle with an upper thread to be moved down to a bottom position thereof, the needle aperture having a first inclined inner surface which is opposite to the point of hook with respect to the needle at the bottom position, a distance between the needle at the bottom position and the first inclined inner surface as measured in a direction parallel to a rotation axis of the bobbin-case holder being decreased in a direction from the outer circumferential surface of the bobbin-case holder toward the inner circumferential surface of the bobbin-case holder.

7 Claims, 5 Drawing Sheets

HORIZONTAL AXIS FULL ROTARY HOOK WITH A BOBBIN CASE HOLDER HAVING A NEEDLE GUIDING MEANS

BACKGROUND OF THE INVENTION

1. Field of the Invention

The present invention relates in general to a full rotary hook for a sewing machine and in particular to such a hook suitable for use with a pattern or embroidery sewing machine.

2. Related Art Statement

A conventional full rotary hook shuttle for such use includes (a) a generally cylindrical hook base having a point of hook, an inner circumferential surface, and a guide groove provided in the inner circumferential surface, and (b) a generally cylindrical bobbin-case holder having an inner circumferential surface, an outer circumferential surface and a part-circumferential rail provided on the outer circumferential surface, the bobbin-case holder being supported by the hook base such that the bobbin-case holder is freely rotatable relative to the rotary hook while the rail is guided by the guide groove.

However, this hook has no means for guiding a sewing needle with a top or upper thread. The hook produces no problem when it is used in a common sewing machine in which a work fabric or cloth is fed in an unchangeable direction. However, when the hook is used with a pattern or embroidery sewing machine in which directions in which a work cloth is fed are often changed, the hook provides a problem that a point of hook fails to catch a loop of the upper thread, producing a skipping stitch or a thread breakage, if continuous feeding of the work cloth is carried out, or if double fabric sewing is carried out using a thick fabric or cloth even by intermittent feeding of the work cloth. The reason for this problem is that the sewing needle is bent slightly away from the point of hook by being pulled by the cloth, depending upon the direction in which the cloth is fed, thereby increasing the possibility that the point of hook fails to catch the upper thread.

For solving the above problem, it has been proposed, as indicated in two-dot chain line in FIG. 3, to provide, between a throat plate 100 and a bobbin-case holder, 20, a needle guide 102 for preventing a sewing needle 2 from being displaced away from a point of hook 16. Alternatively, it has also been proposed to form, in place of a needle hole 104 concentric with the needle 2, a needle hole 106 eccentric with the needle 2 in the throat plate 100, so that the eccentric hole 106 serves for guiding the needle 2.

However, even where these needle guides 102, 106 are used, they come into contact with the upper thread, thereby exerting resistance to the same and reducing tightness of the stitches formed.

SUMMARY OF THE INVENTION

It is therefore an object of the present invention to provide a full rotary hook shuttle which effectively prevents a sewing needle from being displaced away from a point of hook thereof without adversely affecting an upper thread.

The above object has been achieved by the present invention, which provides a full rotary hook for a sewing machine, comprising a generally cylindrical hook having a point of hook base, an inner circumferential surface, and a guide groove formed in the inner circumferential surface; and a generally cylindrical bobbin-case holder having an inner circumferential surface, an outer circumferential surface, and a part-circumferential rail provided on the outer circumferential surface, the bobbin-case holder being supported by the rotary hook such that the bobbin-case holder is freely rotatable relative to the hook base while the rail is guided in the guide groove, the bobbin-case holder having a needle aperture which allows a sewing needle with an upper thread to be moved down to a bottom position thereof, the needle aperture having a first inclined inner surface which is opposite to the point of hook with respect to the needle at the bottom position, a distance between the needle at the bottom position and the first inclined inner surface as measured in a direction parallel to a rotation axis of the bobbin-case holder being decreased in a direction from the outer circumferential surface of the bobbin-case holder toward the inner circumferential surface of the bobbin-case holder.

In the horizontal axis full rotary hook constructed as described above, the sewing needle is guided by the first inclined inner surface of the needle aperture, so that the needle is prevented from being displaced in a direction away from the point of hook. Since the first inclined inner surface guides the sewing needle only, the first inclined inner surface does not come into contact with the upper thread and does not adversely affect the same. Therefore, even in the case where sewing is carried out at a high operational speed by continuous feeding of a work cloth on a pattern or embroidery sewing machine in which the directions of feeding of the cloth are often changed, or in the case where double fabric sewing is carried out using a thick fabric or cloth by intermittent feeding of the cloth, the hook securely catches a loop of the upper thread, without producing a skipping stitch or a thread breakage. In addition, since the upper thread is fed forward smoothly, the sewing is carried out with "well-locked" stitches. A "well-locked" stitch means a stitch formed by an upper and a bobbin thread locking each other in the middle of the thickness of the work cloth.

In a preferred embodiment of the present invention, the needle aperture is an elongate aperture extending in a circumferential direction of the bobbin-case holder, the first inclined inner surface extending in a longitudinal direction of the elongate aperture. The first inclined inner surface extending in the longitudinal direction of the elongate aperture, exhibits the above-indicated advantages even in the event that the sewing needle is bent in that longitudinal direction of the elongate aperture.

In another embodiment of the present invention, the needle aperture has a second inclined inner surface which surface is located on a side of the point of hook with respect to the needle at the bottom position, a distance between the needle at the bottom position and the second inclined inner surface as measured in the direction parallel to the rotation axis of the bobbin-case holder being decreased in the direction from the outer circumferential surface of the bobbin-case holder toward the inner circumferential surface of the bobbin-case holder. The second inclined inner surface serves for preventing the sewing needle from colliding with the point of hook due to elastic deformation of the needle.

In yet another embodiment of the present invention, the needle aperture is an elongate aperture extending in a circumferential direction of the bobbin-case holder, the first and second inclined inner surfaces extending in a longitudinal direction of the elongate aperture. This embodiment provides the advantages produced by both the above two preferred embodiments of the invention.

In a further embodiment of the present invention, the bobbin-case holder has a straight elongate groove formed in the outer circumferential surface thereof so as to extend in a direction perpendicular to the rotation axis of the bobbin-case holder and have a depth which does not reach the inner circumferential surface of the bobbin-case holder, the bobbin-case holder having an elongate hole formed through a bottom of the elongate groove so as to extend parallel to the elongate groove, the needle aperture including the elongate hole and a surrounding portion of the elongate groove which portion surrounds the elongate hole, at least an inner surface of the elongate groove which surface is opposite to the point of hook being inclined with respect to the needle at the bottom position and providing the first inclined inner surface. This needle aperture is easily produced by forming the elongate groove such that at least an inner surface thereof is inclined with respect to the needle at the bottom position and forming the elongate hole through the bottom of the elongate groove. In this case, the elongate hole has a non-inclined inner surface which is not inclined with respect to the sewing needle and which is aligned with the inclined inner surface of the elongate groove. This arrangement serves for increasing the durability of the elongate hole or needle aperture. If the elongate hole or needle aperture has no such non-inclined inner surface, the shape of the hole or aperture as viewed in the direction of reciprocation of the sewing needle is subject to deformation due to wear caused by the friction between the needle and the inner edge of the first inclined inner surface, because the first inclined inner surface has no thickness at the inner edge thereof. In contrast, in the present embodiment, the shape of the elongate hole is hardly changed even if the first inclined inner surface is worn to an appreciable extent.

According to a feature of the present invention, the bobbin-case holder has a recess adjacent to an opening thereof through which a bobbin, around which a bobbin thread is wound, and a bobbin case are inserted in the bobbin-case holder, the recess being engageable with the bobbin thread, the needle aperture being located adjacent to the recess.

According to a feature of the present invention, the recess provides a recessed portion of the bobbin-case holder which portion is engageable with a bobbin holder position bracket for stopping rotation of the bobbin-case holder.

BRIEF DESCRIPTION OF THE DRAWINGS

The above and optional objects, features and advantages of the present invention will be better understood by reading the following detailed description of the presently preferred embodiment of the invention when considered in connection with the accompanying drawings, in which.

DETAILED DESCRIPTION OF THE PREFERRED EMBODIMENT

Figure 1:
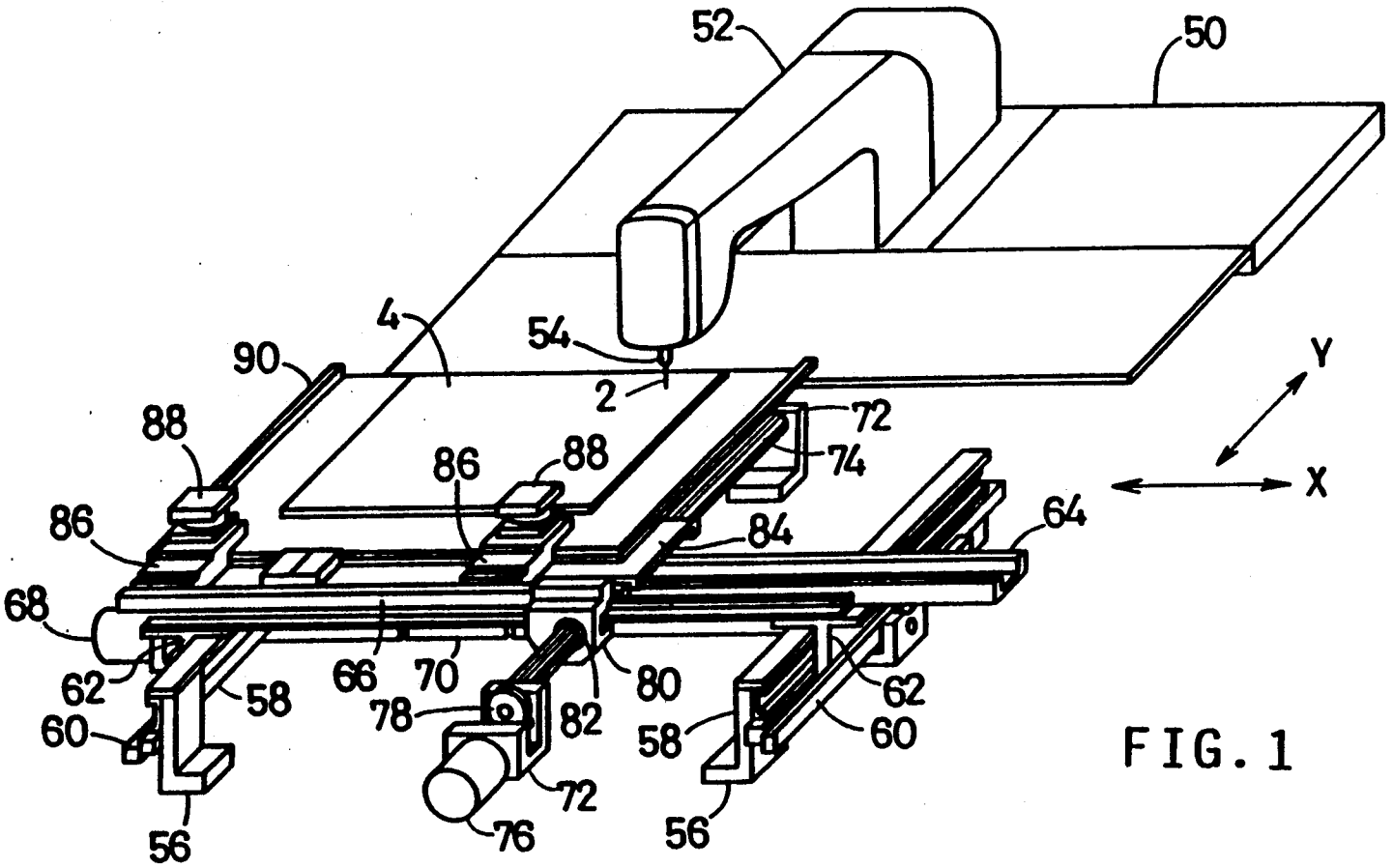
FIG. 1 is a perspective view of an embroidery sewing machine in which a full/hook embodying the present invention is used.

Referring first to FIG. 1, there is shown an embroidery sewing machine in which a horizontal axis full rotary hook in accordance with the present invention is used. On a machine table 50, there is disposed a sewing head 52. A needle bar 54 carrying a sewing needle 2 is reciprocated vertically by being driven by a main motor (not shown) via a main shaft (not shown). A pair of first support members 56, 56, each fixed to the machine table 50, support a pair of first guide rails 58, respectively, which extend in a Y direction indicated at arrow Y in the figure. A first rack 60 is fixed to each first guide rail 58, and a first slide member 62 is mounted on each first rack 60. The two first slide members 62, 62 cooperate with each other to support a movable frame 64 and a second rack 66 such that the frame and rack 64, 66 are movable in the Y direction. A first drive motor 68 drives, via a first shaft 70, a pinion (not shown) threadedly engaged with each first rack 60, thereby moving the frame 64 in a positive and a negative direction of the Y direction.

A pair of second support members 72, 72 support a spline shaft 74 such that the spline shaft 74 extends in the Y direction and is freely rotatable about a rotation axis thereof. A second drive motor 76 drives the spline shaft 74 via a wheel 78. The spline shaft 74 is engaged with a spline bearing 82 supported by a second slide member 80. When the spline shaft 74 is driven by the second drive motor 76, the spline bearing 82 and a pinion (not shown) are rotated, so that the second slide member 80 and a carriage 84 are moved in an X direction perpendicular to the Y direction while being guided by the frame 64. A pallet 90 is secured to the carriage 84 by means of a clamp member 86 and a clamp cylinder 88, and a work fabric or cloth 4 is held by the pallet 90.

The first and second drive motors 68, 76 cooperate with each other to move the work cloth 4 relative to the sewing needle 2 to a desired position in a plane defined by the X and Y directions or axes, so as to form stitches on the work cloth 4. The manner of loop-catching and stitch formation by the sewing machine of this type is disclosed in U.S. Pat. No. 2,680,417.

Figure 2:
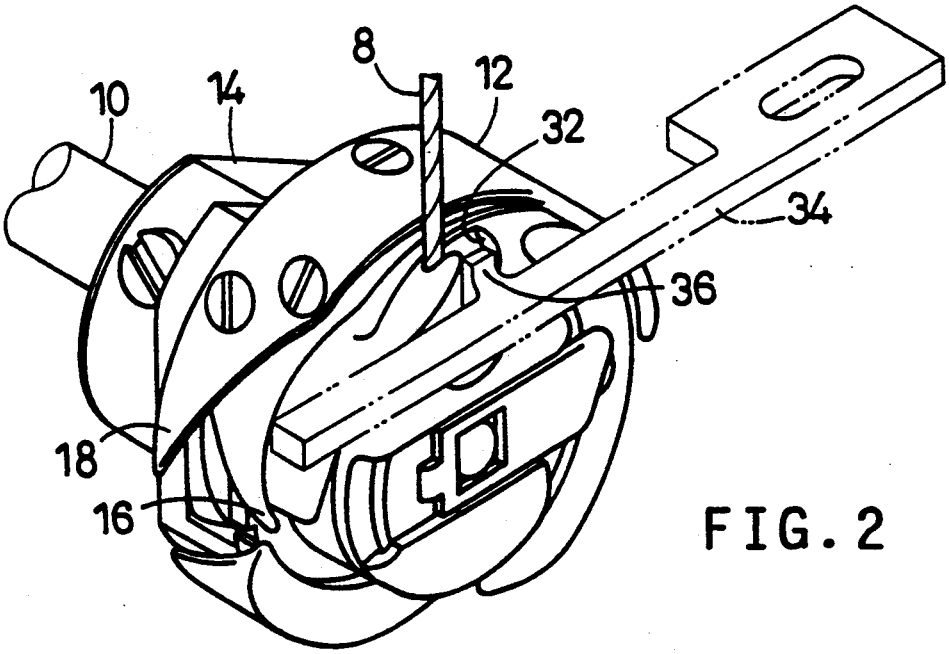
FIG. 2 is a perspective view of the hook in accordance with the present invention.
Figure 3:
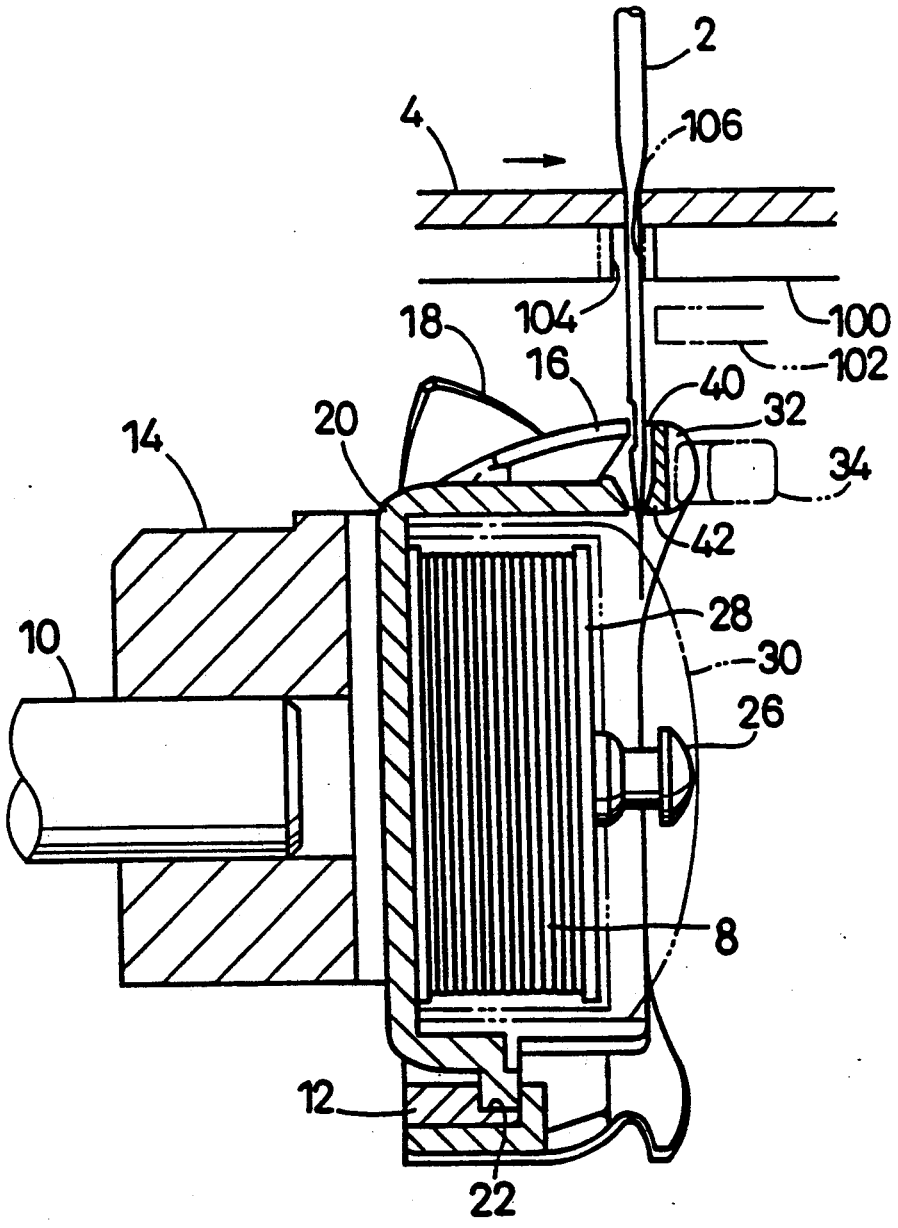
FIG. 3 is a longitudinal cross-sectional view of the hook of FIG. 2.

Referring next to FIGS. 2 and 3, there is shown a horizontal axis full rotary hook in accordance with the present invention. The shuttle includes a base hook 12. The hook base 12 has a boss portion 14 fixed to a rotary shaft 10, so that the rotary hook base 12 is rotatable with the rotary shaft 10. The hook base 12 has a beak or point of hook 16 for catching a loop of an upper thread 6 (FIG. 5), and a cam plate 18 for guiding the upper thread 6 caught by the point of hook 16. The hook base 12 has a generally cylindrical shape and has a raceway or guide groove 22 formed in an inner circumferential surface thereof. The guide groove 22 guides a bobbin-case holder 20 such that the bobbin-case holder 20 is freely rotatable relative to the hook base 12.

Figure 4:
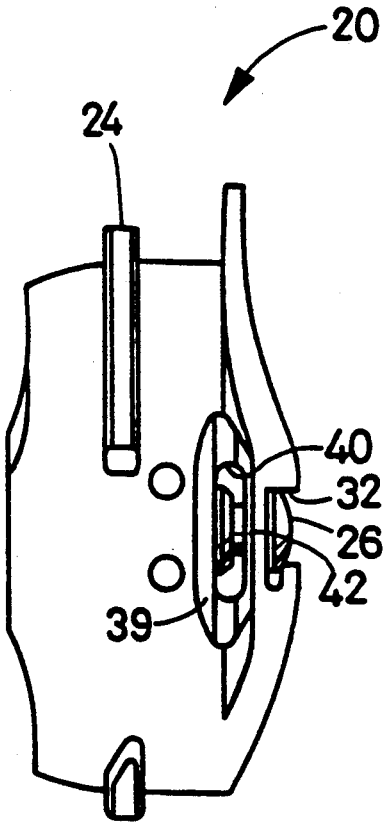
FIG. 4 is a plan view of a bobbin-case holder of the hook of FIG. 2.

As shown in FIG. 4, the bobbin-case holder 20 has a generally cylindrical shape and has a part-circumferential ridge or rail 24 provided on an outer circumferential surface thereof. The rail 24 is engaged with the guide groove 22 of the hook base 12. The bobbin-case holder 20 has, at its central portion, a stud support shaft 26 for supporting a bobbin 28 via a bobbin case 30. A bobbin thread 8 is wound around the bobbin 28. The rotary shaft 10, hook base 12, central stud support shaft 26 of the bobbin-case holder 20, bobbin case 30, and bobbin 28 are coaxial with each other. The bobbin-case holder 20 has, at an upper end portion thereof, an engagement recess 32 adjacent to an opening thereof through which the bobbin 28 and bobbin case 30 are inserted to the bobbin-case holder 20. A bobbin holder position bracket 34 is engageable, at an extension 36 thereof, with the engagement recess 32 of the bobbin-case holder 20, for stopping rotation of the bobbin-case holder 20. The engagement recess 32 is also engageable with the bobbin thread 8. The bobbin-case holder 20 has, at the upper end portion thereof, an elongate aperture 40, 41, 42 adjacent to the engagement recess 32. The elongate aperture 40, 41, 42 allows an end portion of the sewing needle 2 carrying the upper thread 6, to be moved down to a bottom position thereof.

Figure 5:
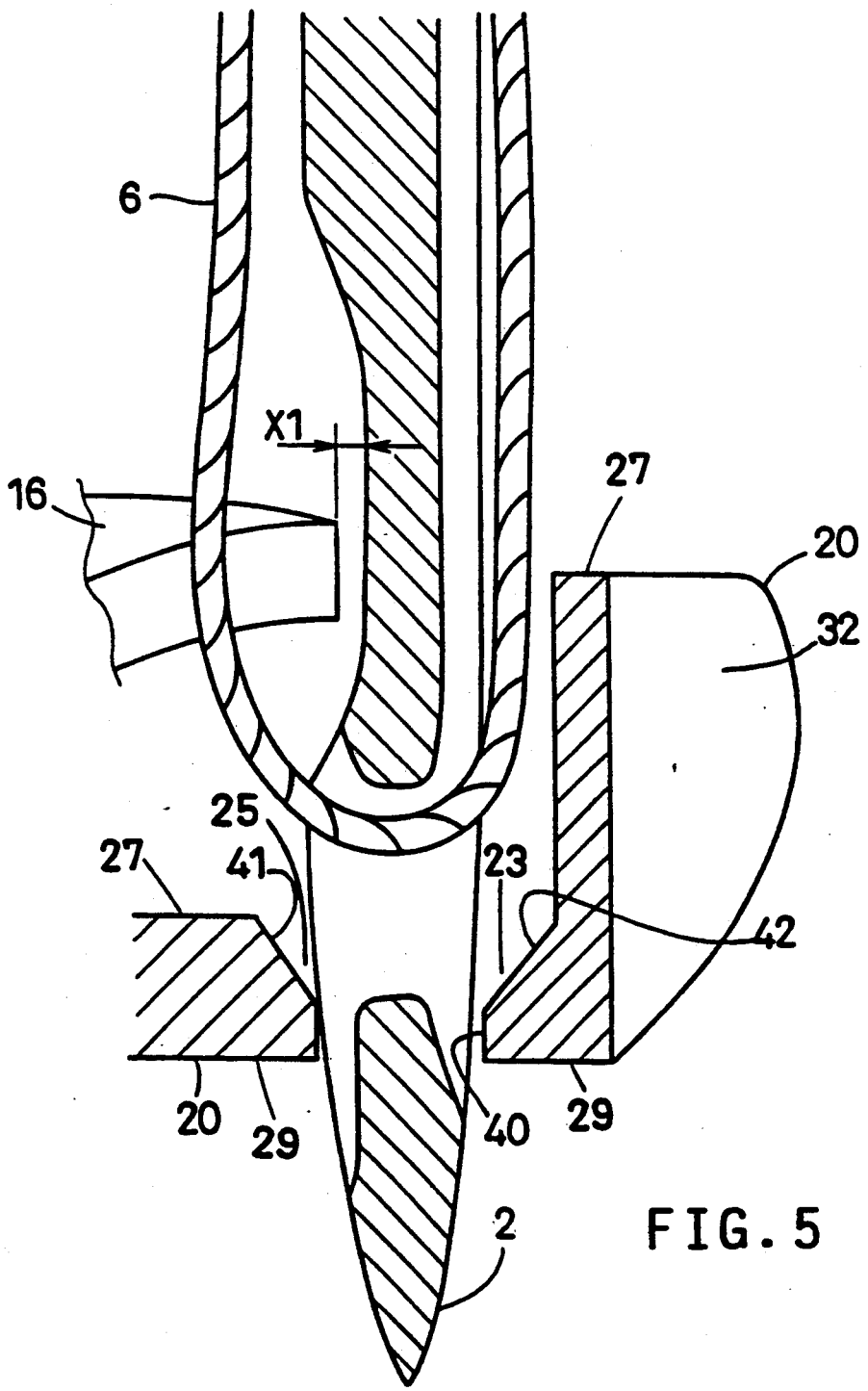
FIG. 5 is a cross-sectional view of an end portion of a sewing needle and a portion of the hook of FIG. 2.

As shown in FIGS. 3 and 5, the needle aperture 40, 41, 42 includes a first inclined inner surface 42 which is opposite to the point of hook 16 with respect to the needle 2 at the bottom position. A distance 23 between the needle 2 at the bottom position and the first inclined inner surface 42 as measured in a direction parallel to a rotation axis of the bobbin-case holder 20 is decreased in a direction from the outer circumferential surface 27 of the bobbin-case holder 20 toward an inner circumferential surface 29 of the same 20. More specifically, the bobbin-case holder 20 has a straight elongate groove 39 formed in the outer circumferential surface 27 thereof so as to extend in a direction perpendicular to the rotation axis of the bobbin-case holder 20 and have a depth which does not reach the inner circumferential surface 29 of the bobbin-case holder 20. The needle aperture 40, 41, 42 includes an elongate hole 40 formed through a bottom of the elongate groove 39 so as to extend parallel to the elongate groove 39. The needle aperture 40, 41, 42 further includes a surrounding portion 41, 42 which surrounds the elongate hole 40. The first inclined inner surface 42 is an inner surface of the surrounding portion 41, 42 which surface is opposite to the point of hook 16 and is inclined with respect to the needle 2 at the bottom position. When the hook base 12 is rotated, the point of hook 16 passes adjacent the needle aperture 40, 41, 42, for catching a loop of the upper thread 6. The surrounding portion 41, 42 includes a second inclined inner surface 41 which surface is located on a side of the point of hook 16 with respect to the needle 2 at the bottom position. A distance 25 between the needle 2 at the bottom position and the second inclined inner surface 41 as measured in the direction parallel to the rotation axis of the bobbin-case holder 20 is decreased in the direction from the outer circumferential surface 27 of the bobbin-case holder 20 toward the inner circumferential surface 29 of the same 20.

The function of the first inclined inner surface 42 is as follows: When sewing is carried out on the work cloth 4 by continuous feeding of the cloth 4 in the Y direction, or when double fabric sewing is carried out using a thick fabric or cloth 4 by intermittent feeding of the cloth 4, the sewing needle 2 is pulled by the work cloth 4 being fed and consequently the needle 2 is bent slightly in a direction of feeding of the cloth 4, i.e., away from the point of hook 16, thereby increasing a distance, $X_1$, between the point of hook 16 and the needle 2 and possibly resulting in that the point of hook 16 fails to catch a loop of the upper thread 6. It is desired that distance $X_1$ fall within the range of 0 to 0.1 mm. If distance Xexceeds the upper limit of this range, the problem will be encountered with increased probability that the point of hook 16 will fail to catch the upper thread 6, thereby producing a skipping stitch or a "single-ply" stitch. A "single-ply" stitch means a stitch formed by only one or two plies of the upper thread 6 being locked by the bobbin thread 8, where the upper thread 6 consist of three plies twisted. However, according to the principle of the present invention, since the needle aperture 40, 41, 42 of the bobbin-case holder 20 has the first inclined inner surface 42, the end portion of the sewing needle 2 is guided by the first inclined inner surface 42, so that the needle 2 is prevented from being displaced away from the point of hook 16, i.e., distance $X_1$ between the needle 2 and the point of hook 16 is prevented from excessively being increased. This arrangement enables the point of hook 16 to easily catch the upper thread 6, i.e., prevents the point of hook 16 from failing to catch the upper thread 6. Thus, the upper thread 6 is caught by the point of hook 16 with high reliability.

In addition, the first inclined inner surface 42 of the needle aperture 40, 41, 42 comes into contact only with the end portion of the sewing needle 2, and does not contact the upper or bobbin thread 6, 8. Consequently, the first inclined inner surface 42 does not adversely affect the upper or bobbin thread 6, 8, thereby ensuring that the threads 6, 8 are fed forward smoothly and therefore that sewing is effected with well-locked stitches being produced.

While the present invention has been described in its presently preferred embodiment with detailed particularities, it is to be understood that the present invention may be embodied with various changes, improvements and modifications that may occur to those skilled in the art without departing from the scope and spirit of the invention defined in the appended claims.

What is claimed is:

1. A horizontal axis full rotary hook for a sewing machine, comprising:

a generally cylindrical hook base having a point of hook, an inner circumferential surface, and a guide groove formed in said inner circumferential surface; and a generally cylindrical bobbin-case holder having an inner circumferential surface, an outer circumferential surface, and a part-circumferential rail provided on said outer circumferential surface, said bobbin-case holder being supported by said hook base such that the bobbin-case holder is freely rotatable relative to the hook base while said rail is guided in said guide groove, said bobbin-case holder having a needle aperture which allows a sewing needle with an upper thread to be moved down to a bottom position thereof, said needle aperture having a first inclined inner surface which is opposite to said point of hook with respect to said needle at said bottom position, a distance between said needle at said bottom position and said first inclined inner surface as measured in a direction parallel to a rotation axis of said bobbin-case holder being decreased in a direction from said outer circumferential surface of the bobbin-case holder toward said inner circumferential surface of the bobbin-case holder.

2. The hook as set forth in claim 1, wherein said needle aperture is an elongate aperture extending in a circumferential direction of said bobbin-case holder, said first inclined inner surface extending in a longitudinal direction of said elongate aperture.

3. The hook as set forth in claim 1, wherein said needle aperture has a second inclined inner surface which surface is located on a side of said point of hook with respect to said needle at said bottom position, a distance between said needle at said bottom position and said second inclined inner surface as measured in said direction parallel to said rotation axis of said bobbin-case holder being decreased in said direction from said outer circumferential surface of the bobbin-case holder toward said inner circumferential surface of the bobbin-case holder.

4. The hook as set forth in claim 3, wherein said needle aperture is an elongate aperture extending in a circumferential direction of said bobbin-case holder, said first and second inclined inner surfaces extending in a longitudinal direction of said elongate aperture.

5. The hook as set forth in claim 1, wherein said bobbin-case holder has a straight elongate groove formed in said outer circumferential surface thereof so as to extend in a direction perpendicular to said rotation axis of the bobbin-case holder and have a depth which does not reach said inner circumferential surface of the bobbin-case holder, said bobbin-case holder having an elongate hole formed through a bottom of said elongate groove so as to extend parallel to said elongate groove, said needle aperture including said elongate hole and a surrounding portion of said elongate groove which portion surrounds said elongate hole, at least an inner surface of said elongate groove which surface is opposite to said point of hook being inclined with respect to said needle at said bottom position and providing said first inclined inner surface.

6. The hook as set forth in claim 1, wherein said bobbin-case holder has a recess adjacent to an opening thereof through which a bobbin, around which a bobbin thread is wound, and a bobbin case are inserted in the bobbin-case holder, said recess being engageable with said bobbin thread, said needle aperture being located adjacent to said recess.

7. The hook as set forth in claim 1, wherein said recess provides a recessed portion of said bobbin-case holder which portion is engageable with a bobbin holder position bracket for stopping rotation of the bobbin-case holder.

* * * * *